United States Patent [19]

Haller

[11] 4,048,711

[45] Sept. 20, 1977

[54] WIRE INSERTION APPARATUS

[75] Inventor: Freidrich A. Haller, Chicago, Ill.

[73] Assignee: TRW Inc., Elk Grove Village, Ill.

[21] Appl. No.: 549,714

[22] Filed: Feb. 13, 1975

[51] Int. Cl.[2] ..... H01R 43/04

[52] U.S. Cl. ..... 29/566.3; 29/749

[58] Field of Search ..... 29/203 MW, 203 H, 203 HT, 29/203 D, 203 DT, 203 P, 203 J, 628, 566.3, 566.4, 749, 751, 753

[56] References Cited

U.S. PATENT DOCUMENTS

| | | | |
|---|---|---|---|
| 3,758,935 | 9/1973 | Long et al. | 29/203 MW |
| 3,800,390 | 4/1974 | Johnston | 29/203 MW |
| 3,803,695 | 4/1974 | Tucci | 29/203 H |
| 3,886,641 | 6/1975 | Davis | 29/203 MW |
| 3,952,392 | 4/1976 | Nijman et al. | 29/203 MW |

*Primary Examiner*—Carl E. Hall

*Attorney, Agent, or Firm*—Neuman, Williams, Anderson & Olsen

[57] ABSTRACT

A termination tool is disclosed of the type having a plurality of rams for simultaneously forcing wires laterally into terminals on opposite sides of a connector. The connector is mounted in the tool, in a holder assembly having side members which are laterally translatable in response to control apparatus to permit the connector to be inserted and removed from the holder assembly. The aforementioned wire or wires are properly positioned with respect to the ram end portions and the connector terminals by means of guides included in the side members. The rams are mounted on pivoted arms and are variably extendable therefrom to compensate for differences in thickness or width of various connectors.

27 Claims, 20 Drawing Figures

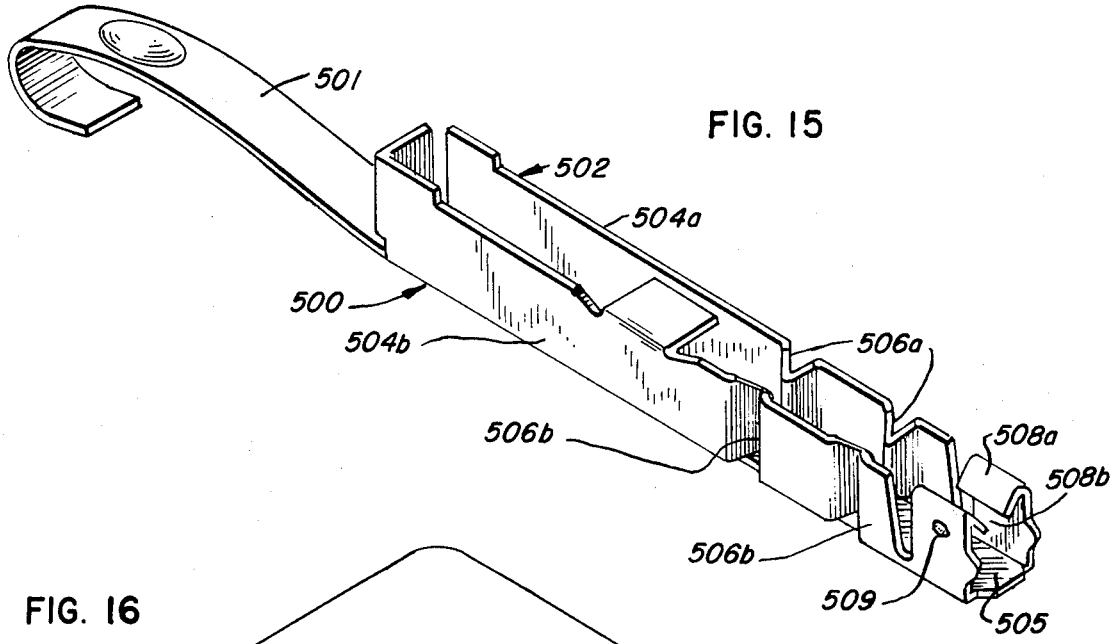
FIG. 15
FIG. 16
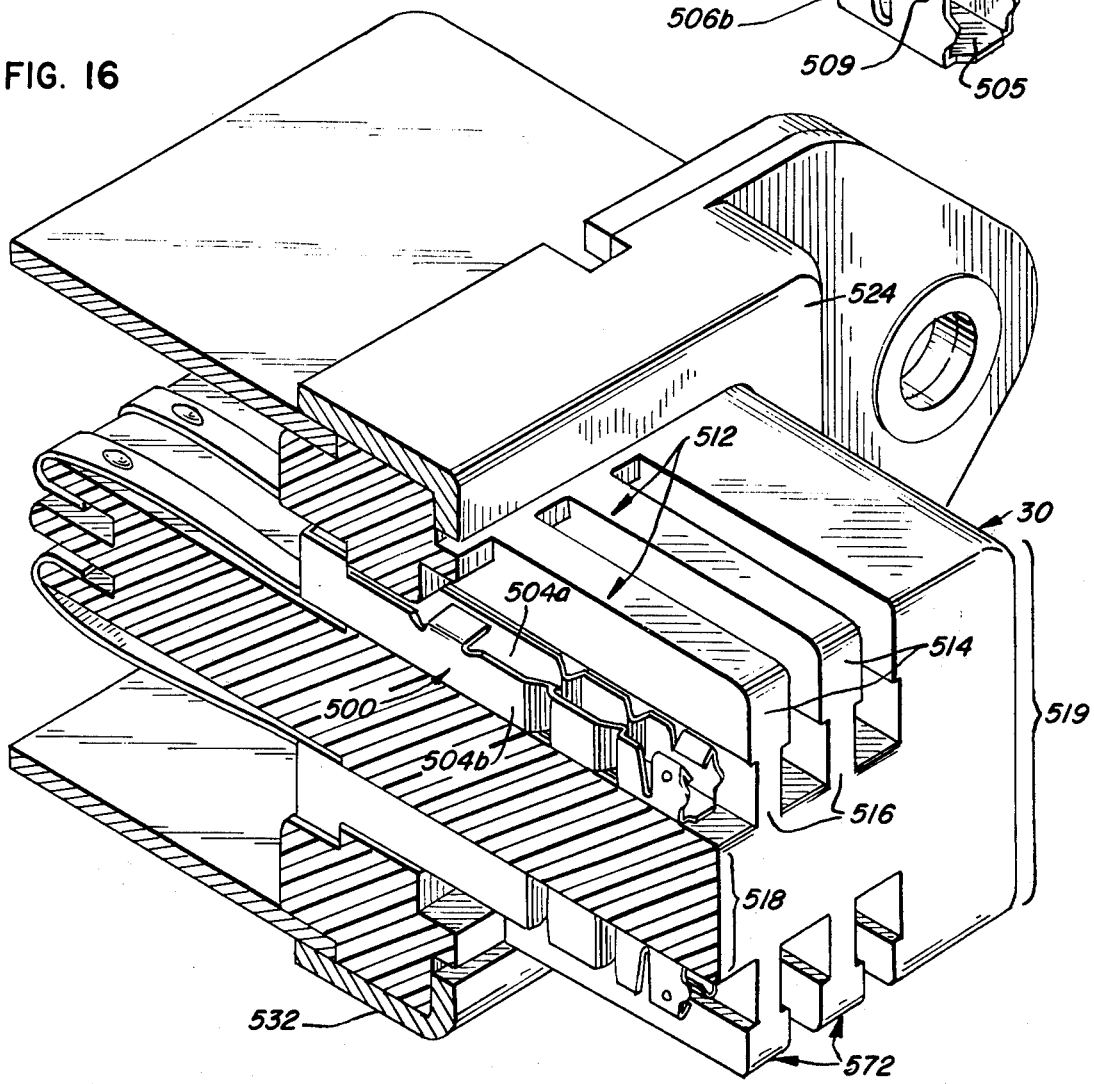

WIRE INSERTION APPARATUS

This invention relates to apparatus for terminating wires in connectors and, specifically, to apparatus for terminating wires in solderless connectors.

In recent years, numerous forms of solderless connectors have been developed. These include improved connectors employing an improved terminal such as illustrated in FIGS. 15 and 16 of the drawings herein and disclosed more fully in two copending applications, namely, McKee application Ser. No. 443,730, filed Feb. 19, 1974 and McKee and Witte application Ser. No. 443,678 filed Feb. 19, 1974. In conjunction with the development of various connectors, a variety of devices for inserting wires in such connectors have been produced. By way of example, various tools and devices for effecting terminations in solderless connectors are disclosed in three copending applications, namely, McKee application Ser. No. 502,085, filed Aug. 30, 1974, now abandoned, McKee application Ser. No. 502,086, filed Aug. 30, 1974, now Pat. No. 3,997,956, and Witte application Ser. No. 549,715 filed Feb. 13, 1975, now U.S. Pat. No. 3,999,270.

It is an object of this invention to provide an improved wire insertion apparatus and, more specifically, to provide improved wire insertion apparatus which is suitable for use with a variety of connectors employing solderless terminals of the general type disclosed in the aforementioned applications.

While the apparatus disclosed herein is adapted to such use, it is by no means limited to that particular use. Many applications of the invention disclosed herein, all equally within its spirit and scope, will become obvious to those skilled in the art. Similarly, further and additional objects and advantages will appear from the description, accompanying drawings and appended claims.

In an illustrative embodiment of this invention, a termination tool having a plurality of rams with advantageously formed insertion end portions is employed in forcing wires laterally into corresponding terminals of a connector. The wires are properly positioned with respect to the rams and connector terminals by means of guides included in the tool. The guides themselves are incorporated in a connector holder assembly into which the connector is placed and held throughout the insertion operation. These guides are laterally translatable relative to one another and may be positioned by means of control apparatus in either of two predetermined relative positions for insertion or removal of the connector. In addition, the entire holder assembly is laterally translatable within defined limits. The rams are mounted in pivoted arms and are extendable to various lengths to accommodate differing connector dimensions. Wires which are inserted by the tool are trimmed as they are moved toward the terminals of the connector by cooperation between the rams and advantageous severing edges of the guides.

For a more complete understanding of this invention, reference should now be had to the embodiments illustrated in greater detail in the accompanying drawings and described below by way of examples of the invention.

In the drawings:

FIG. 1 is a perspective view of a termination tool employing teachings of the invention;

FIGS. 2*a* and 2*b* are partial plan views of the connector hold assembly and the control therefor of the tool shown in FIG. 1, in two positions of operation;

FIGS. 3*a* and 3*b* are partial schematic views of the control mechanism for positioning the connector holder assembly shown in FIGS. 2*a* and 2*b;*

FIGS. 4*a* and 4*b* are partial sectional views of the holder assembly taken along line 4—4 in FIG. 5 and looking in the direction of the arrows, with the components in changed positions and including a corresponding sectional view of one ram arm assembly in FIG. 4*b;*

FIG. 5 is a partial longitudinal sectional view taken along line 5—5 of FIG. 4*b* and looking in the direction of the arrows;

FIG. 5*a* is an oblique view of the cable clamp assembly shown in FIGS. 1 and 5, in the cable clamping position;

FIG. 15 is an enlarged oblique view of an individual terminal of the type included in a connector as shown in FIGS. 13 and 16; and FIG. 16 is an enlarged partial view of a multiterminal connector, including a plurality of the terminals shown in FIG. 15.

Figure 1:
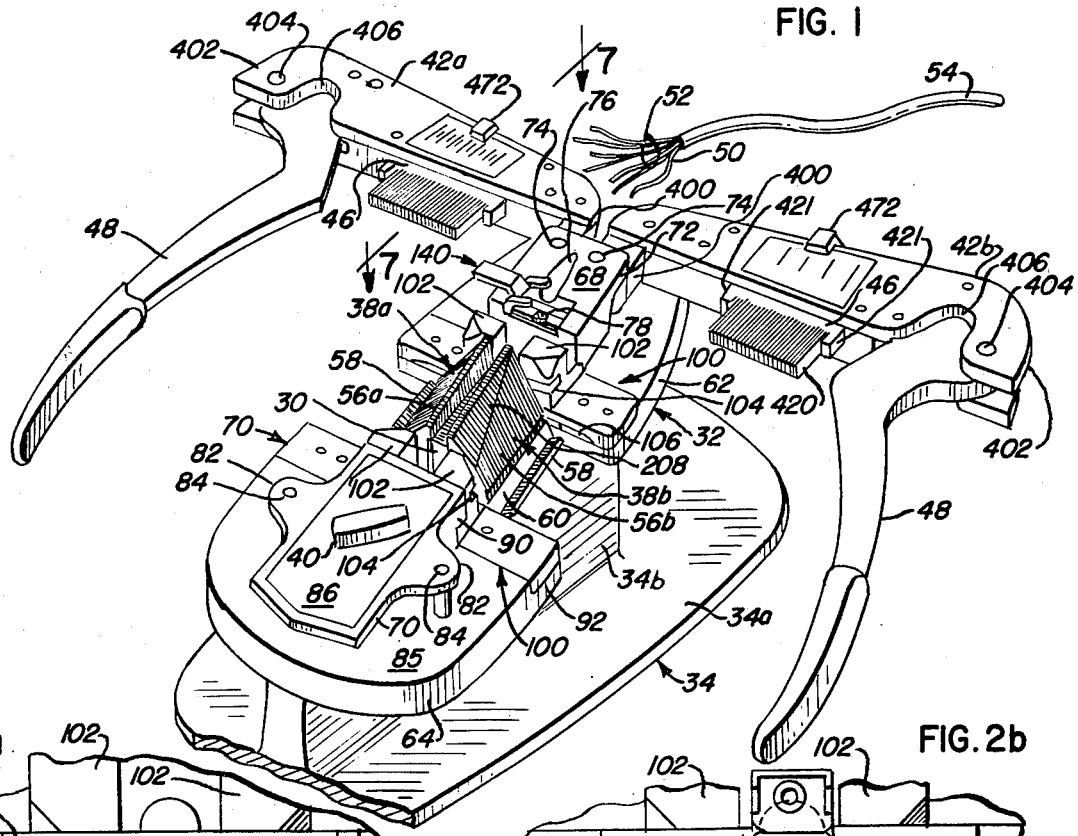
Figure 4A:
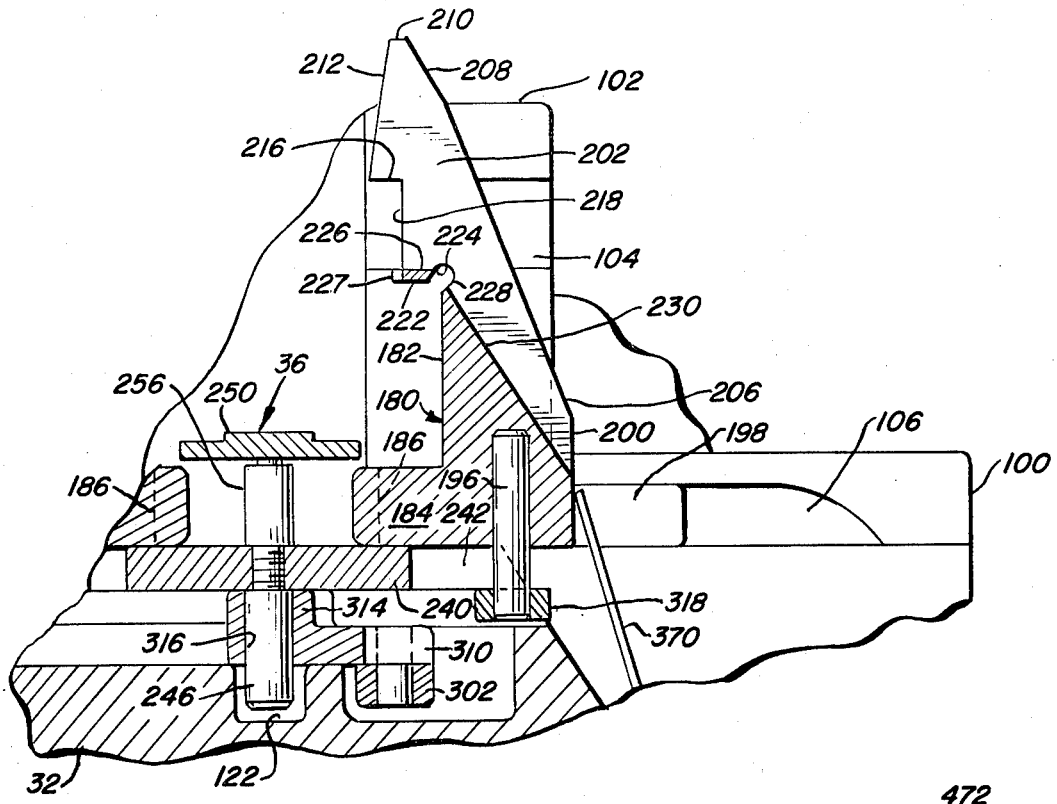

Referring now to the drawings, FIG. 1 shows an illustrative tool embodying the invention. The tool is designed for holding a connector 30 and terminating a plurality of wires therein. The tool includes a frame assembly 32 mounted on a support 34. The support comprises a base plate 34*a* and and a pedestal 34*b* which is configured such that the frame assembly 32 and the manipulative components of the tool are maintained at an inclined attitude facing an operator. Those manipulative components include, generally, a connector holder assembly comprising a clamp plate subassembly 36 (FIGS. 4*a,* 4*b,* 11 and 12), a pair of side members 38*a* and 38*b* and a holder control 40, together with a pair of ram arms 42*a* and 42*b* which carry ram blocks 46, and a pair of force amplification arms 48. The clamp plate subassembly and side members form a carriage or nest in which a connector 30 is held while terminating wires 50 and 52 of a cable 54 in the connector. The side members 38*a* and 38*b* include guide combs 56*a* and 56*b* each consisting of a plurality of ribs. The spaces between these ribs are registered with the terminals of the connector 30 such that the ribs of the combs serve to guide wires 50 and 52 in alignment with the terminals of the connector 30 as the wires are prepositioned and subsequently are terminated in the connector by the rams of ram blocks 46 upon appropriate manipulation of the arms.

A secondary comb 58 and a color code plate 60 are provided on each side of the frame, beneath the side members.

Referring now particularly to FIGS. 1, 4*a*, 4*b* and 5, the frame assembly 32 includes a frame support plate 61 having a forward portion 62 and a rearward portion 64 connected by a central portion 66. A clamp and arm support member 68 is centrally mounted on the forward plate portion 62 and a control support member 70 is centrally mounted on the rear portion 64.

The clamp and arm support member 68 includes a forward flange 72. One end of each of a pair of pins 74 is mounted in the flange 72, the other end of each being secured to the forward plate portion 62. The support member 68 also includes a cable receiving depression 76, an upper clamp cavity 78 and a lower clamp cavity 80. The lower clamp cavity 80 is positioned over the rectangular hole 81 in the forward frame portion 62.

The control support member 70 includes a pair of opposing, laterally extending flanges 82 in which are mounted a pair of pins 84. The distal ends of the pins 84 are secured to the upper surface 85 of the rear plate portion 64. The upper surface 86 of the support member 70 is appropriate for the display of selected legends to assist the operator in the use of the control 40.

The forward portion of the support member 70 includes a flange 90 and the rear frame portion 64 includes a complementary recess which jointly define a channel 92 extending laterally across the entire width of the support plate 61. A somewhat similar flange 94 and complementary recess define a similar channel 96 across plate 61 beneath the rearward portion of the clamp and arm support 68. These flanges and channels mate with lower rails 98 of a pair of guide members 100. Each guide member 100 includes a pair of transversely spaced posts 102 which extend vertically upward from the respective rail and which are formed with transverse guide channels 104 as illustrated. In addition, each of the guide members 100 includes (opposite the respective rail 98) a guideway 106 forming a channel with a horizontal surface 108 of the central support plate portion 66.

Figure 4B:
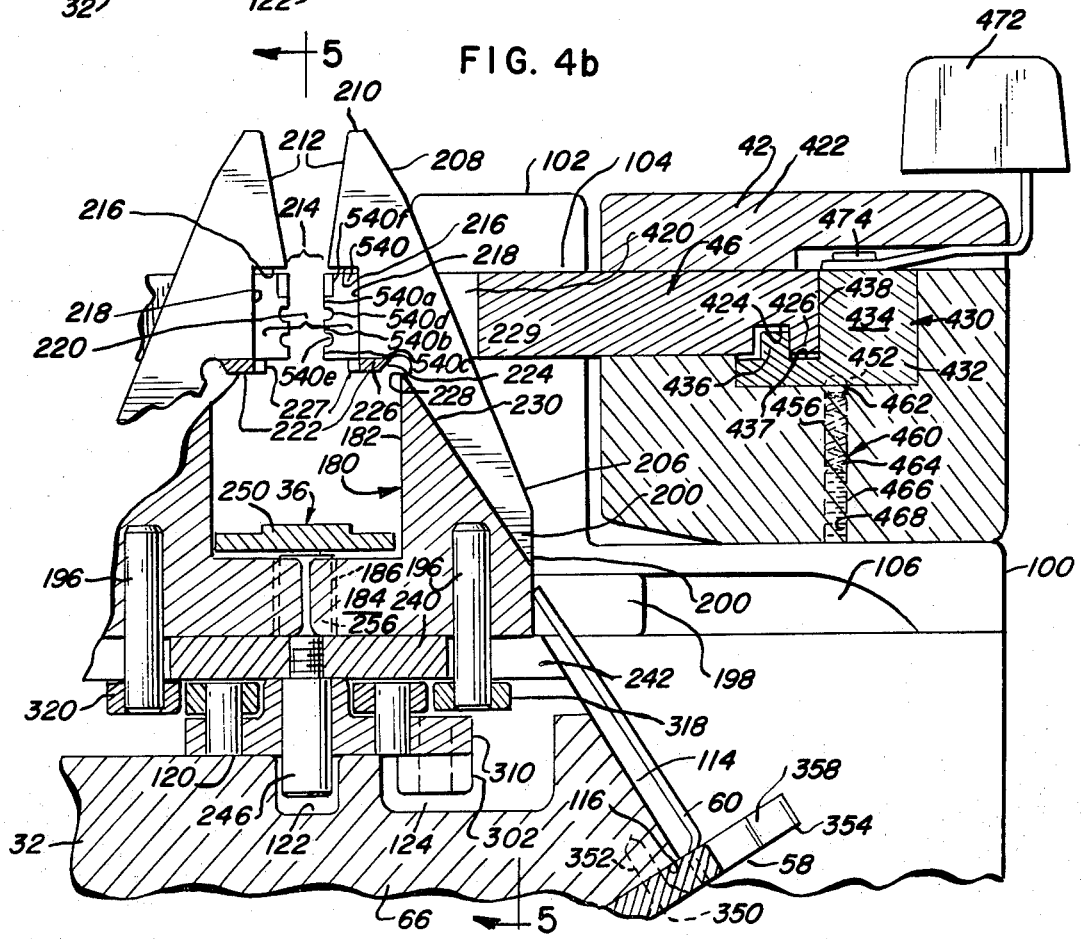

The central plate portion 66 is formed with a central well 109, along with a pair of transverse keyways 110 and a pair of transverse shoulders 112 in a surface 113 at each side of the well. The well 109 includes a first recess 120 and deeper recesses 122 and 124. The recess 122 is of a generally oval cross-section, having its major axis oriented transverse to the plate 61. The recess 124 is rectangular in form and extends longitudinally of the tool into communication with a recess 126 on the underside of the rear plate portion 64. Referring particularly to FIG. 4*b*, the outer and lower side surfaces 114 and 116 of the central frame plate portion 66 are inclined relative to the base 34*a* and adjoin each other at approximately a right angle.

Figures 5, 5A, 9:
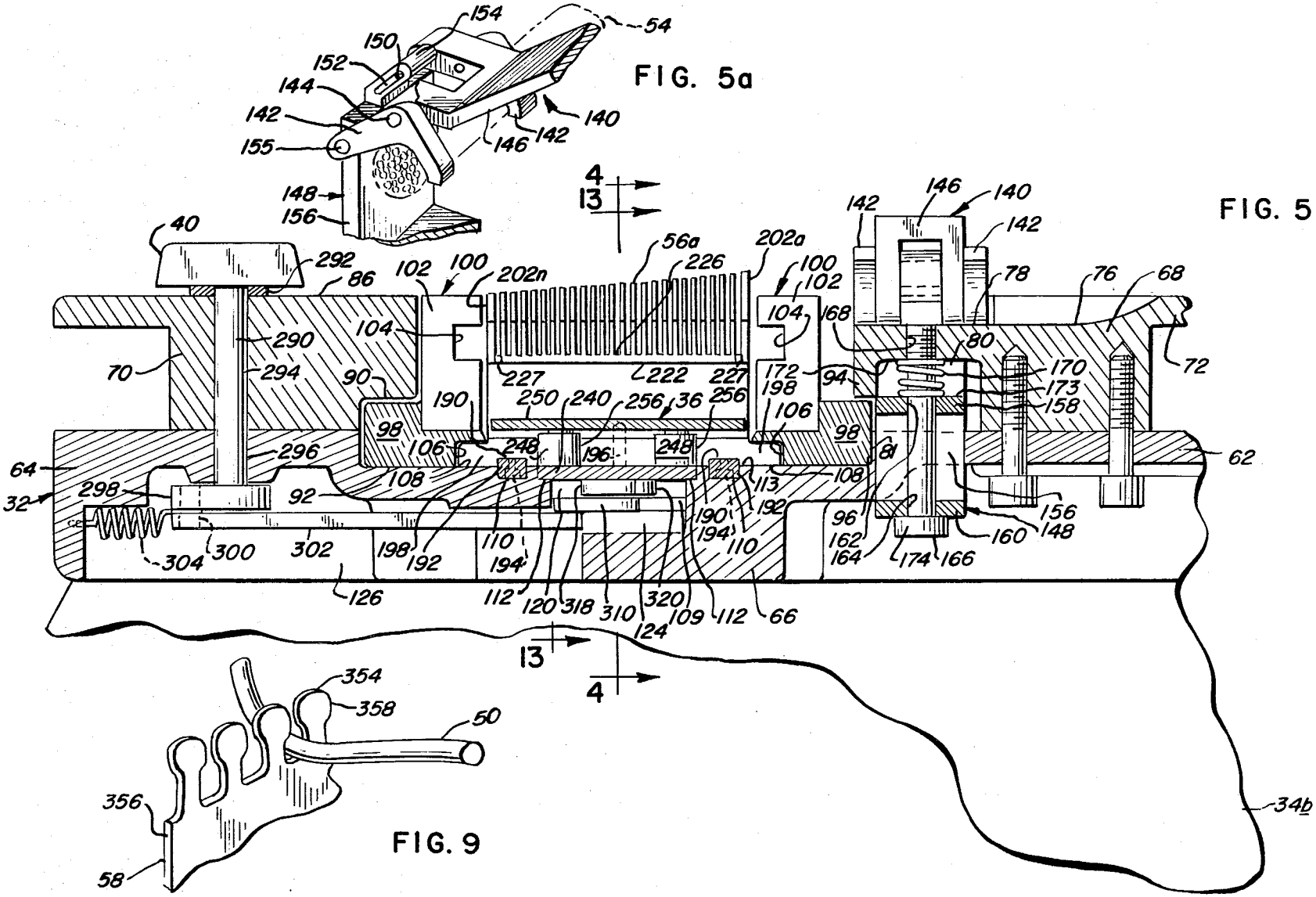
FIG. 9 is an oblique view of a secondary comb shown in FIG. 1.

The clamp and arm support member 68 supports a cable clamp assembly shown generally at 140 in FIGS. 1, 5 and 5*a*. The clamp assembly 140 includes jaws 142 of generally L shape which are connected by pins 144 to a clamp lever 146. The jaws and clamp lever are shown in the cable release position in FIG. 5 and in the cable clamping position in FIG. 5*a*. The lever 146 is connected to a double L member 148 by a pin 150 which engages an elongated slot 152 in a tongue 154 extending angularly upward from the member 148 over the cable position, as seen in FIG. 5*a*. The jaws 142 also are connected to the upper end of the double L member 148 by pins 155. The double L member 148 includes a planar vertical leg 156 and two planar horizontal legs 158 and 160 extending from one side of the leg 156 and spaced along its length. Aligned holes 162 and 164, in the legs 158 and 160, accept a bolt which also engages a tapped hole 168 located in the center of the upper clamp cavity 78 of the support member 68. A compression spring 170 surrounds the bolt 166 and is confined between the lower surface 172 of the support member 68 and the upper surface 173 of the leg 158 to urge the member 148 downwardly toward a limit position wherein the lower surface of the leg 160 abuts a head 174 of the bolt 166. It should be noted that in alternative arrangements, a tension spring similar to spring 170 could be secured at one end to the base 34 with a connecting linkage from the distal end of that spring to the planar leg 160, thus, having the same effect of urging the member 148 downward. Pivoting of lever 146 downward by an operator to the position of FIG. 5*a* results in clamping of a cable 54 beneath jaws 142 against the floor of recess 78 - 80 by the resilient force of spring 170. Toggle action of the lever 146 and joined components provides a locking action with any of a wide variety of cable sizes.

Referring to FIGS. 2*a*, 2*b*, 4*a*, 4*b*, 5 and 10, the side members 38*a* and 38*b* are, in virtually all respects, mirror images of each other and will be discussed accordingly. Each of these members is an integral element, typically being machined from a block of metal. Each side member includes a generally L-shaped lower portion shown generally at 180 and comprising a vertical portion 182 and a horizontal leg portion 184. The leg portion 184 is formed with semicircular recesses 186 in its forward edge. The undersurface 187 of the portion 180 is formed with a pair of keyways 190 positioned to correspond with keyways 110 in the frame 32. Keys 192 engage the aforementioned keyways, providing translational guidance and support for the side members. One of the keys is secured to each of the side members by a screw 194 (FIG. 5).

A pin 196 is secured to each side member and extends from the undersurface 187 of the portion 180. Rails 198 extend along the ends of the side members and adjoin the portion 184. The rails extend beyond the outer end wall 200 of each side member and are of appropriate dimensions to engage the guideways 106 in guide members 100.

Figure 10:
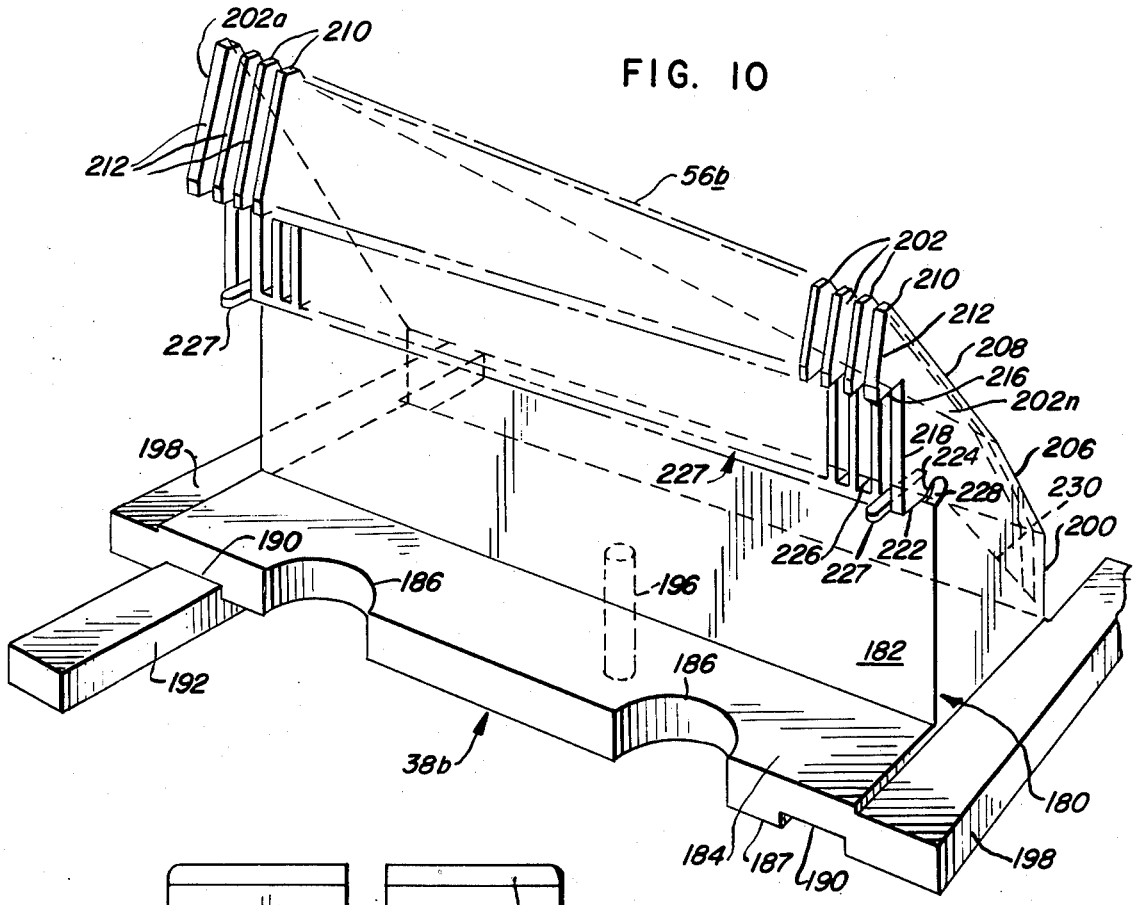
FIG. 10 is an enlarged oblique view of one of the connector holder assembly side members shown in FIG. 1.
Figure 11:
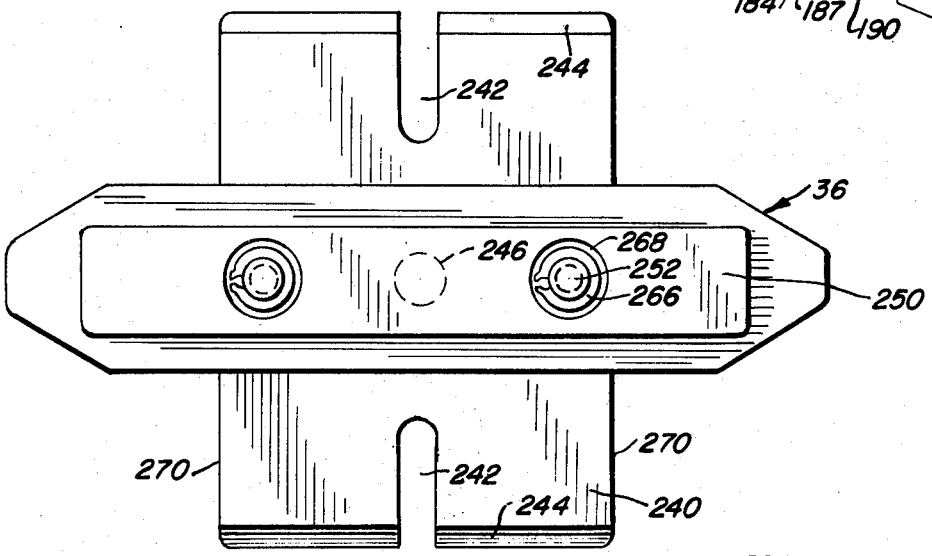
FIG. 11 is a plan view of a clamp plate sub-assembly shown in FIGS. 4*a,* 4*b* and 5.
Figure 12:
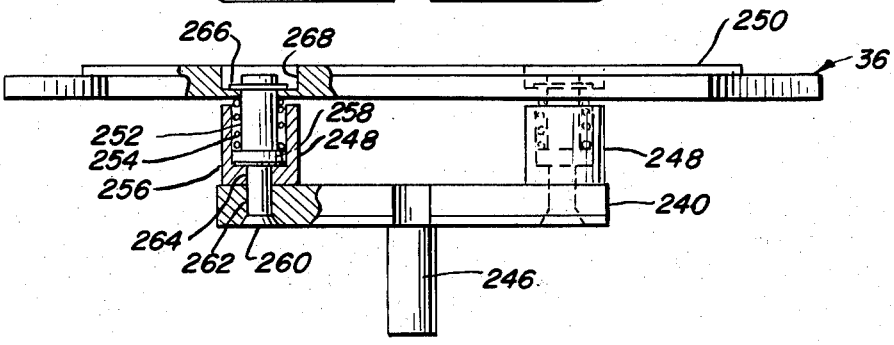
FIG. 12 is a front view, partially in section, of the clamp plate sub-assembly shown in FIG. 11.

The guide combs 56*a* and 56*b* which are part of each of the side members include a plurality of ribs. These ribs extend above the aforedescribed lower portion 180 of each side member and downward along the outer surface of the side member. More specifically, the combs include a plurality of ribs 202, each of generally similar shape, but varying in some respects one with another. As outer edge or surface 200 of each rib extends vertically. A second edge 206 extends upwardly and inward, relative to the body of the tool, and is terminated at an edge surface 208, which latter surface extends upwardly and inward at a lesser slope. The lengths of the edge surfaces 206 and 208 vary with each of the respective ribs as can be seen in FIGS. 1 and 10. At one end of the combs, the surface 206 extends over most of the height of the comb while surface 208 is virtually non-existent; whereas at the other end of the combs, surface 208 is substantially equal in length to the surface 206, in accordance with the varying heights of the ribs discussed further below.

Each surface 208 terminates in a horizontal surface 210 which adjoins a surface 212 which slopes downward and generally inward of the tool. Each sloping surface 212 is terminated at generally the level of the upper surface of the channel 104 in the posts 102. The surfaces 212 extend sufficiently inward of the tool that the distance 214, shown in FIG. 4*b* between the extreme inward points of the surfaces 212 of two opposing ribs 202, when the side members are closed as in this figure, approximates but is slightly greater than the distance 518 between the bottoms of corresponding terminal channels on opposite sides of the connectors in which wires are to be terminated, e.g., the connector 30 shown in FIG. 16.

Each surface 212 adjoins a horizontal surface 216 which, in turn, adjoins a vertical surface 218. The surfaces 218 are positioned such that the distance 220 (FIG. 4*b*) between opposing surfaces 218 when the side members are closed approximates the distance 519 between the outer surfaces of corresponding ribs on opposite sides of the connectors, see again FIG. 16. This dimension and the other dimensions related to the connector being terminated of course may vary with different types of connectors and between male and female connectors of the same general type. The surfaces 218 extend downward of the tool a distance approximating but greater than the width of the channels 104, as can be seen clearly in FIG. 4*b*, and merge with coplanar inner surfaces of bridging segments 226 which form, with the ribs, a continuous longitudinal bar portion 227 of the respective side member 38. The horizontal undersurface 222 of bar portion 227 extends to a surface 224. Surface 224 slopes generally upward and outward of the tool over at least the full thickness of the segments 226 to intersect the top surfaces of these bridging elements and thereby form a sharp cutting edge on each bridging element 226 between adjacent ribs 202; see FIGS. 4*a* and 4*b*. The bridging element at each end of the row of ribs includes an integral, inwardly extending alignment nub 227, as shown.

In the illustrated tool the surface 224 is obtained by a machining operation which results in a U-shaped notch 228 extending the length of the side member at the intersection of surface 222 with portion 182. The notch 228 also communicates with surfaces 230 which slope generally downward and outward of the tool and form the bottoms of the channels between adjacent ribs 202. Both the surfaces 230 and the surfaces 206 adjoin the plane of the end wall surfaces 200.

The respective ribs extend vertically to varying heights. More specifically, the rib 202*a* is taller than the rib 202*n* (FIG. 5), with the intermediate ribs being of sequentially stepped, intermediate heights and having horizontal top edges, as shown. This variation in height assists the operator in distinguishing between and selecting the various channels into which wires are to be placed.

Referring now particularly to FIGS. 4*a*, 4*b*, 5, 11 and 12, the clamp plate subassembly 36 includes a base plate 240 having aligned transverse slots 242 and beveled end surfaces 244. A pin 246 is secured centrally of the plate 240 and extends from its undersurface. Two compressible spacers 248 are employed to connect a support plate 250 to the base plate 240. Each spacer 248 includes an inner spindle 252 surrounded by a spring 254 and a spacer housing 256. The spindle 252 includes a hub 258 at one end. The spindle is secured to the base plate 240 by means of a screw 260 passing through holes 262 in base plate 240 and 264 in housing 256. Each spindle is secured to the support plate 250 by means of a snap ring 266 engaging a groove in the distal end of the spindle which is disposed in a depression 268 in the upper surface of the support member 250. The spring 254 is compressively confined between the hub 258 and the support member 250 to urge the support member upward away from the base plate 240. The housing 256 is of a height less than the maximum separation distance between the lower surface of the support member 250 and the upper surface of the base plate 240 such that the member 250 may be displaced vertically downward a predetermined distance.

The clamp plate subassembly 36 is mounted on the center portion 66 of the support plate with the side portions 270 of the base plate 240 resting on the shoulders 112, see FIG. 5. The side members 38 are mounted above the base plate 240, on the slide keys 192, with the pins 196 of the side members 38 extending through the slots 242. Engagement of the keys 194 in the respective ways, and engagement of the rails 198 in the guideways 106, permit guided lateral sliding movement of the side members relative to one another and to the frame components, between the positions shown in FIGS. 4*a* and 4*b*. The aforementioned recesses 186 in the side members accommodate the spacer housings 256 when the side members are closely disposed as in FIG. 4*b*.

As mentioned above, the side members 38 and the clamp plate subassembly 36 form a carriage or nest for mounting a connector. Each of the side members is translatable laterally in response to control 40. Referring particularly to FIGS. 1, 2*a*, 2*b*, 3*a*, 3*b*, 4*a*, 4*b*, and 5, the control mechanism for the side members 38 includes the control knob 40 which is connected to a shaft 290. The shaft 290 passes through bushing 292 and hole 294 in support member 70 and hole 296 in frame 32, and is connected to arm 298. The arm 298 is, in turn, connected by pivot pin 300 to linkage rod 302. It should be noted that a spring 304, shown in phantom, may be connected to the arm 298 to bias that arm to the position shown in FIG. 3*b*. The spring is connected between hole 306 in arm 298 and pin 308 in the frame 32.

The rod 302 is connected to a clamp toggle 310 by means of pin 312. The clamp toggle 310 includes a hub 314 pivotally engaging the pin 246 on base plate 240. The pin 246 extends into the recess 122, which has a diameter greater than that of pin 246 to permit limited lateral movement of the toggle 310. The clamp toggle 310 also is connected to two C-shaped toggle arms 318 and 320 by pins 322 and 324, respectively. Holes in the outer ends of the arms 318 and 320 receive the pins 196 of the side members, which pins 196 pass through slots 242 in the base plate 240 of subassembly 36. The slots 242 permit lateral sliding motion of the pins 196 therein; however, they are sufficiently restraining to limit the motion of the pins to the directions of the arrows shown in FIGS. 3*a* and 3*b* at 330 and 332. As can be seen most clearly in FIG. 3*b*, the toggle arms are sufficiently offset that with the arm 298 rotated to the position shown in FIG. 3*b*, the centers of the pins 196, 322 and 324 are substantially co-linear with the center axis of pin 246 or slightly over-center to effect locking of the side members in inward positions relative to one another. Movement of arm 198 to the position of FIG. 3*a* causes pins 196 and hence side members 38*a* and 38*b* to be spread or moved outward relative to one another.

Referring to FIGS. 1, 4*a*, 4*b* and 9, the secondary combs 58 are connected to the side surface 116 of the frame 32 by means of screws 350 engaging tapped holes 352 in the frame 32. Each secondary comb includes a plurality of flexible ribs 354 extending in a linear array from a base member 356. The ribs 354 include enlarged end portions 358 of sufficient dimensions to prevent a wire, such as wire 50, from being placed between the ribs 354 or from being removed without adequate force to flex the ribs. The ribs are, however, sufficiently spaced that they do not provide compressive force against the sides of a wire therebetween.

The color code plates 60 are rotatably mounted to the secondary combs 58 on each side of the tool. The distal end of each plate 60 rests against the surface 200 of a side member. Each color code plate includes a chart to assist an operator in selecting appropriately color-coded wires.

Figure 6:
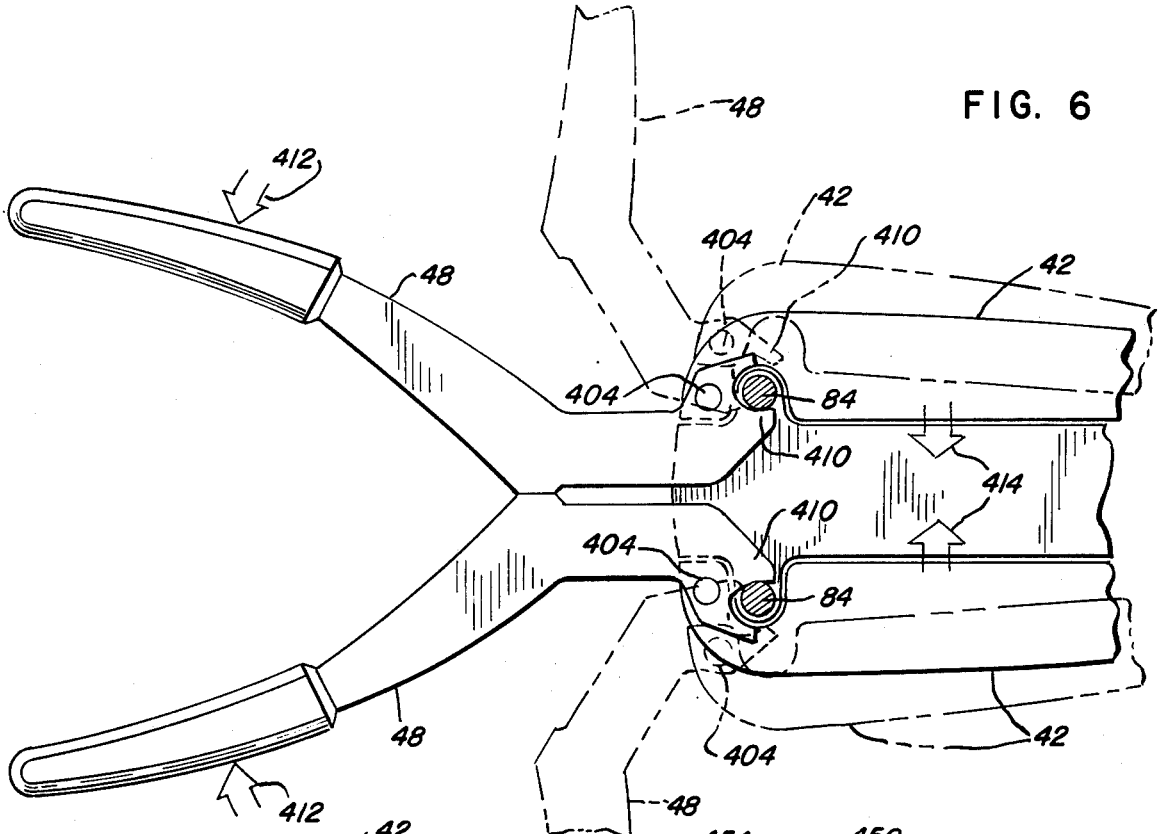
FIG. 6 is a schematic view of the ram arms and related mechanism shown in FIG. 1 in two positions of operation.

Referring to FIGS. 1, 4*b*, 6 and 7, the ram arms 42*a* and 42*b* include short lateral extensions 400 which engage the pins 74 for pivotally mounting the arms on the support member 68. Each ram arm 42 includes at its distal end a clevis portion having a pin 404 mounted therein. The clevis elements include recessed areas 406 of an appropriate size and shape for accommodating the respective extending flange 82 on the support member 70. The force amplification arms 48 are pivotally mounted to the arms 42 by means of the pins 404. Each of the arms 48 includes a jaw 410 of an appropriate configuration for engaging the respective post 84 very near the pin 404, as best seen in FIG. 6. The arms 48 thus function as second class levers to apply a large closing force to the respective arms 42 through the pins 404 as a result of operator force applied at 412. The closing is shown schematically in FIG. 6 where both sets of arms are shown in two positions of operation. First, the phantom lines show the two sets of arms after preliminary closing and positioning of the arms, just prior to application of force for final termination of wires in an insertion operation. As the arms 48 are rotated toward one another by application of manual effort in the direction of the arrows 412, the jaws 410 bear against posts 84 as the fulcrum, and a closing force of large magnitude is applied through the pins 404 to the arms 42 in the direction of the arrows 414.

Referring particularly to FIGS. 1, 4*b*, 7 and 13, each of the ram blocks 46 includes a plurality of rams 420 and a pair of ram block end guide members 421, all protruding in mutually parallel relationship to one another from a base section 422. A recess or groove 424 is formed across the underside of each base section thereby providing a downwardly extending rib or flange 426 at the rearward end of the block for purposes to be noted below. Each of the blocks projects through, and is laterally confined by the sides of a passage 428 in the respective arm. These passages align the blocks, longitudinally of the arms, such that the rams 420 pass in the interstices between the ribs 202 and the ram block guide members 421 pass in the channels 104 of the end posts 102 when the arms 42 are rotated toward the closed position of FIG. 14.

Figure 7:
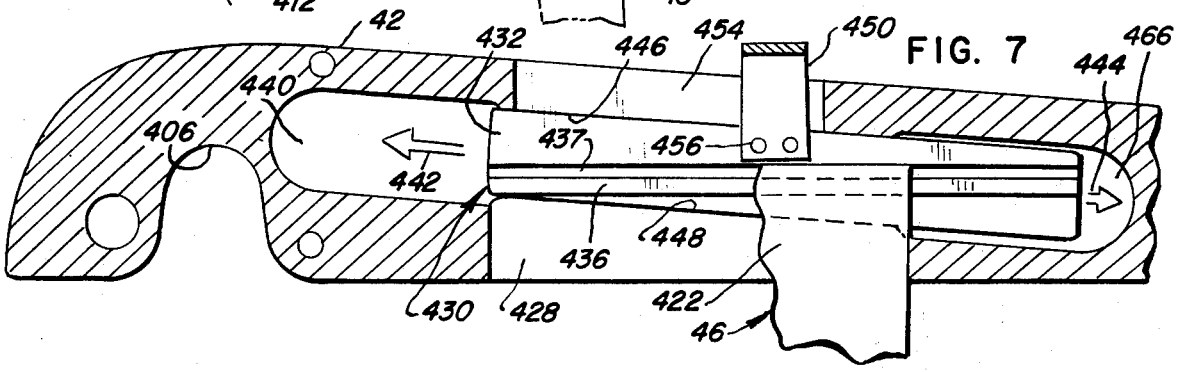
FIG. 7 is a partial ssectional view of one of the ram arms taken generally along the line 7—7 of FIG. 1 and looking in the direction of the arrows.
Figure 13:
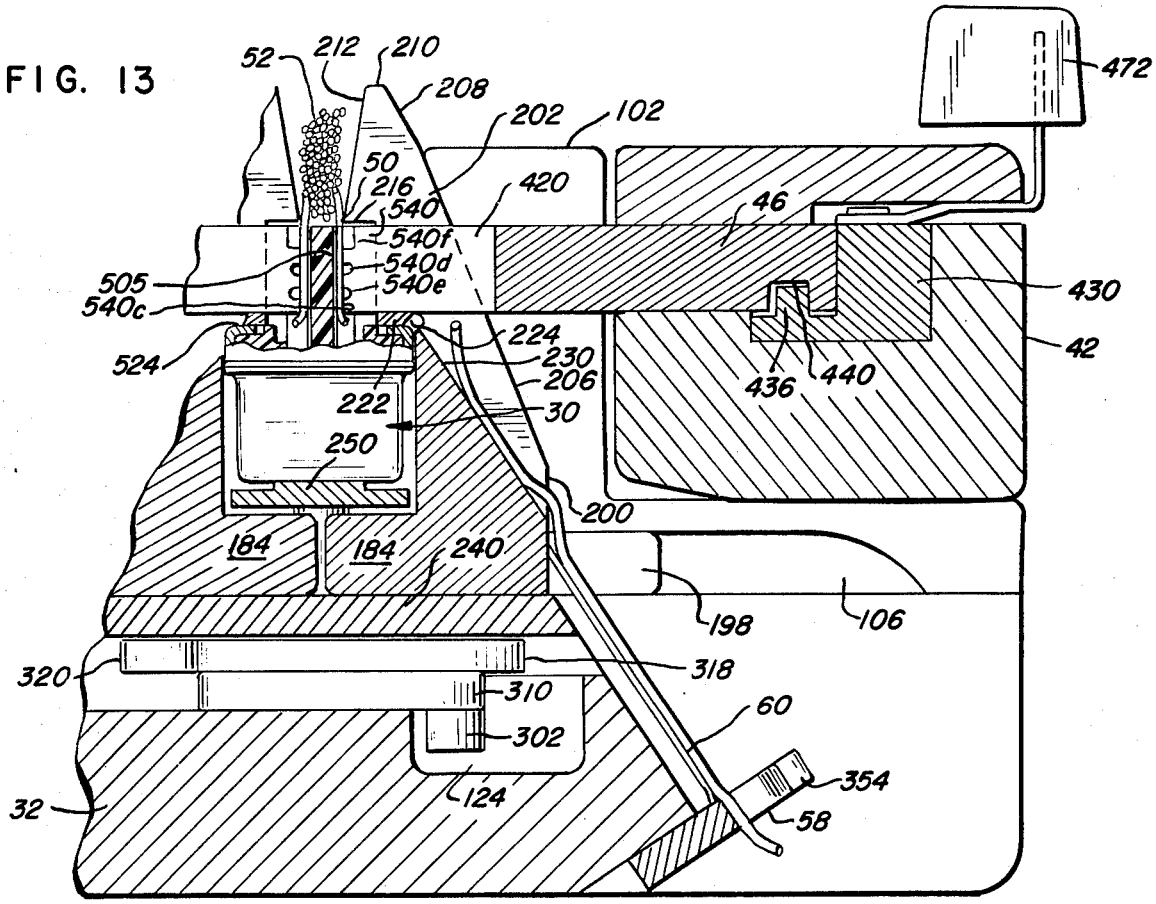
FIG. 13 is a partial sectional view of the connector holder assembly with a connector therein, as taken along the irregular line 13—13 of FIG. 5 and looking in the direction of the arrows.

Each of the ram blocks 46 is connected to a variable extension assembly, shown generally at 430 in FIGS. 4*b* and 7. The assemblies 430 secure the ram blocks in the arms 42, while providing selective adjustment of the extension of each set of rams from the respective arm. Each assembly 430 includes a slide bar 432 having an L-shaped body portion 434. The bar 432 has a rib or jaw 436 and a groove or channel 437 which interengage with the groove 424 and rib 426 of the respective ram block 46, as seen in FIGS. 4*b* and 13, in a manner permitting relative sliding movement between the slide bar and ram block longitudinally of the engaged ribs and grooves.

Each of the arms 42 includes an elongated cavity 440 for receiving the respective slide bar 432. Each cavity is of adequate length to permit the slide bar 432 to be displaced longitudinally along its axis, in the direction of arrows 442 and 444. Parallel side wall shoulder sections 446 and 448 of each cavity 440 provide accurate lateral positioning support for the respective slide bar 432. These side walls and the engaged sides of the respective slide bar extend at a shallow angle to the interengaged ribs and grooves. Accordingly, longitudinal sliding movement of each bar 432 results in a wedging action between the bar and the walls of the cavity 440, which results in relative lateral displacement of the rib 436 and groove 437 and attendant adjustment of the extension of the connected ram block relative to the arm. In the illustrated embodiment this wedge angle is attained with the mating grooves and ribs extending normal to the longitudinal center line of the ram blocks and to the end walls of the passages 428, and disposing the shoulders 446 – 448 and the sides of the bar 432 at an angle to that center line, as illustrated. Stated conversely, the ribs and grooves extend diagonally of the slide bar. A handle bracket 450 carrying a manual adjustment knob 452 (FIG. 1) extends through an outer slot 454 and is attached to the respective bar 432 by pins 456.

The wedge angles of the adjustment assemblies in the two arms 42 may differ from one another to provide different degrees of adjustability of the two sets of rams. In the illustrated embodiment, one assembly 430 is of a wedge angle such as shown in FIG. 7 and has a detent stop assembly 460 as shown in FIG. 4*b* for quick and accurate adjustment of one ram block 46 to readily and selectively adapt the tool to different connectors, such as male or female connectors of the same general design or to connectors of other designs or dimensions. This detent assembly comprises a ball 462, a spring 464 and a set screw 466 for retaining the spring within a cylindrical passage 468. The spring is compressed to urge the ball 462 into any one of a plurality of suitably located dimples 470 in the lower surface of the bar 432. The assembly 430 in the other arm is of a substantially lesser wedge angle for fine adjustment of the extension of the respective ram block such as to calibrate the tool and to adjust for wear, and has a set screw lock (not shown) to retain the adjustment assembly in any position of adjustment.

In preparation for a discussion of the previously mentioned insertion end portions of the rams 420 and a discussion of the actual insertion of wires into a connector 30 by means of the illustrated tool, reference is first made to FIGS. 15 and 16 wherein the connector 30 and the terminals used in the connector are illustrated.

As was mentioned, the terminal shown in FIG. 15 is fully described in the noted copending applications. However, a brief description of the terminal and the connector shown in part in FIG. 16 is included here for convenience. Specifically, a terminal 500 includes a contactor finger 501 and a trough or channel-like body section 502 defined by parallel sides 504*a* and 504*b* and a bottom or rear wall 505. Along the length of the trough 502 jaws 506*a* extend from the side 504*a* into the trough, and opposing jaws 506*b* extend from the side 504*b* into the trough. The opposing pairs of jaws thus form narrowed areas in the trough. Opposing strain-relief tabs 508*a* and 508*b* extend from the upper edges of the respective sides angularly downward into the trough, over support dimples 509. Consequently, the cross-section of the trough 504 varies along its length. This configuration of the trough 504 is useful with respect to the solderless connection of wires therein. More specifically, the insulation of a wire forced laterally into the trough between the jaws 506, in a direction of movement transverse to the longitudinal axis of the wire, is torn or ruptured by the jaws, and electrical contact is established between the jaws 506 and the conductor core of the wire. In addition, the insulation of a wire forced between the tabs 508 is gripped by these tabs which then serve the function of a strain-relief mechanism.

Referring to FIG. 16, several terminals 500 are assembled in a connector 30, e.g., 50 terminals in two opposed rows for terminating 25 pairs of telephone wires. The connector 30 includes parallel-spaced ribs 512, some of which have been cut away in FIG. 16 for clarity of presentation. The ribs 512 include outer guide portions 514 and inner support portions 516 which abut the sides 504*a* and 504*b.* The abutment support portions 516 serve to support the sides of the terminals 500 to prevent spreading of the opposed sides and expansion of the trough therebetween when a wire is forcibly inserted therein.

In the above discussion, reference was made to the distances between the bottoms of corresponding terminal channels and between the outer surfaces of corresponding ribs on opposite sides of the connector. Those distances are indicated in FIG. 16 at 518 and 519, respectively, and vary in different makes and models of connectors, including variances as between the male and female connectors of mating pairs.

A detailed discussion of the characteristics of the insertion end portion of the rams 420 is included in a copending application of W. H. McKee, Ser. No. 502,086, filed Aug. 30, 1974. However, referring briefly to FIG. 4*b,* the insertion end portion or blade 540 of a ram 420 includes an insertion surface consisting of coplanar surfaces 540*a,* 540*b* and 540*c.* These surfaces are separated by depressions 540*d* and 540*e.* In addition, the surface segment 540*a* includes a portion 540*f* of diminished thickness. As will be seen subsequently, these characteristics of the blade 540 permit it to be used successfully with the aforementioned solderless terminals.

Figure 2A:
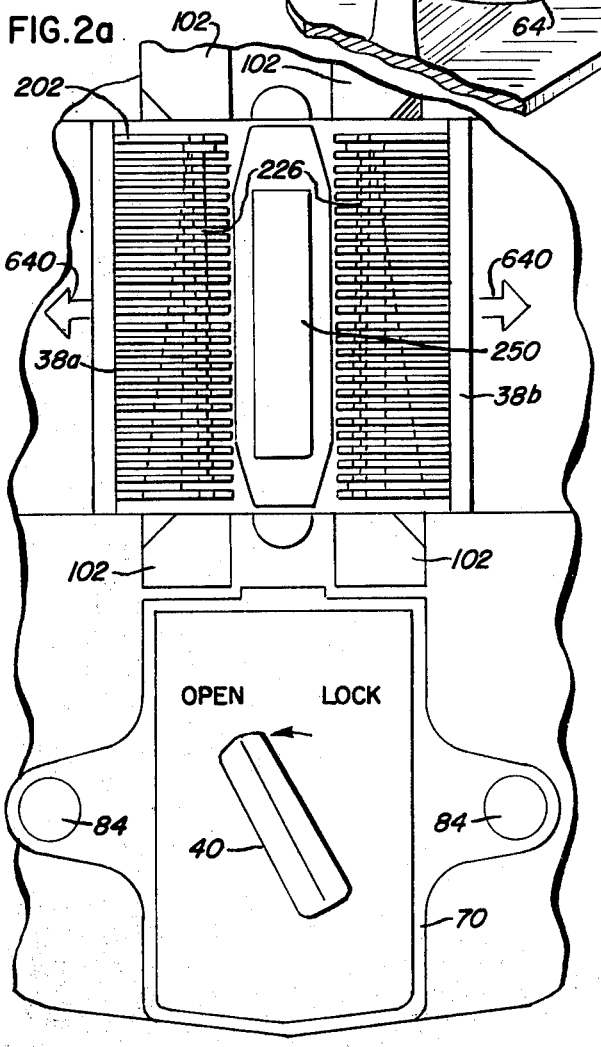
Figure 2B:
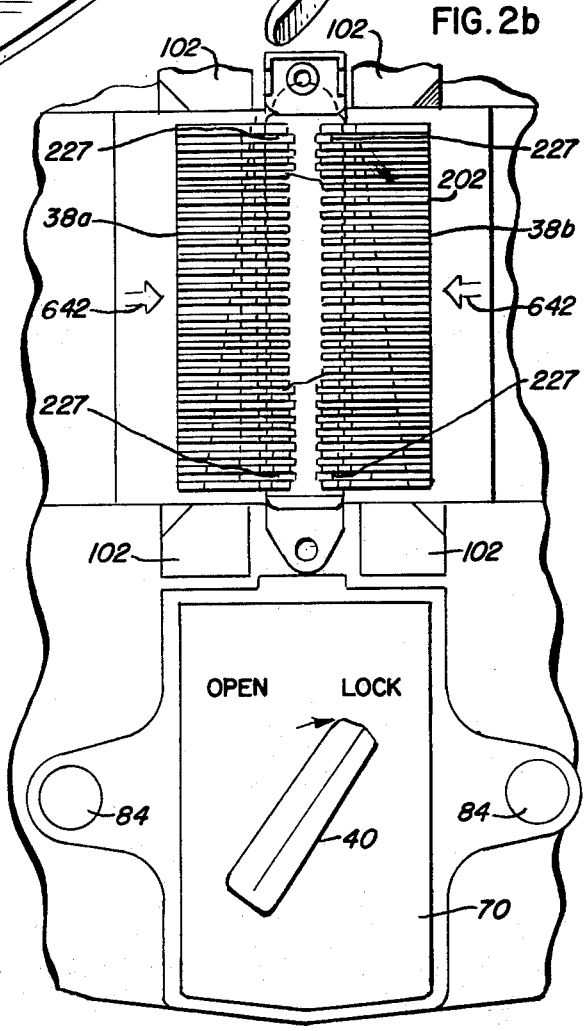
Figure 3A:
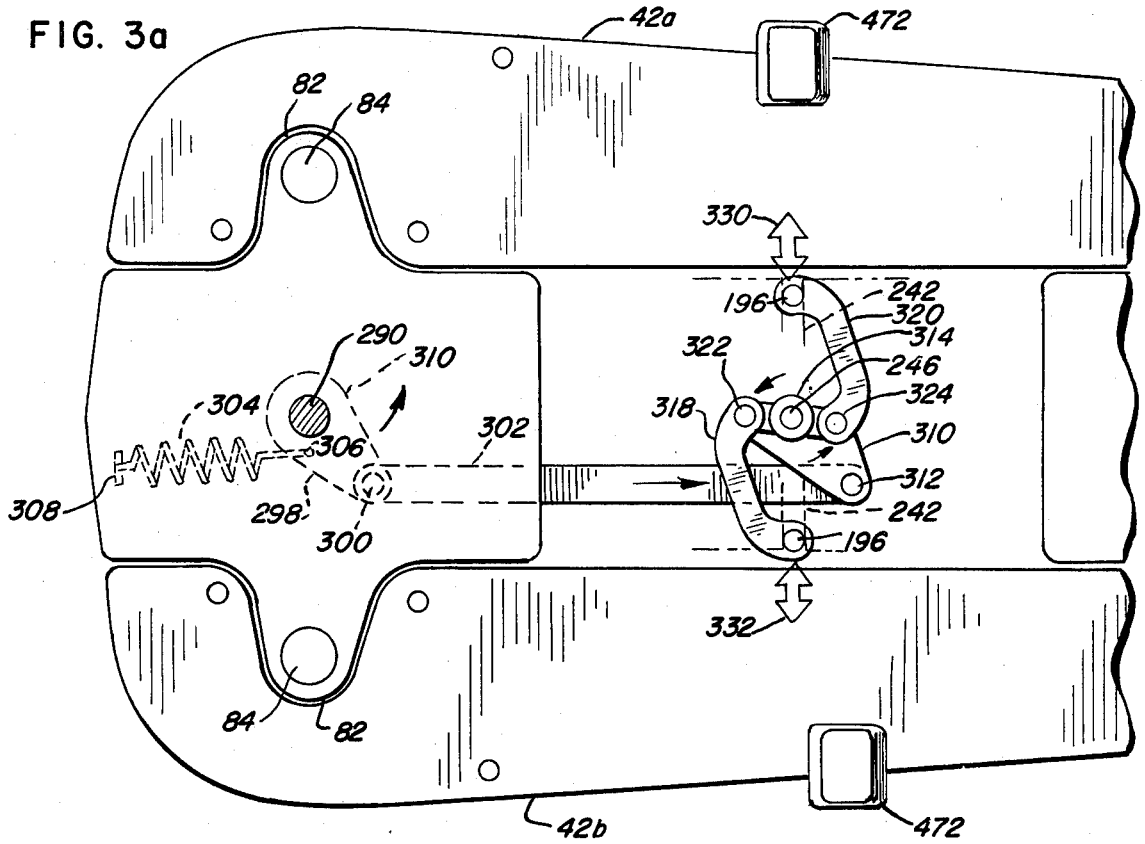
Figure 3B:
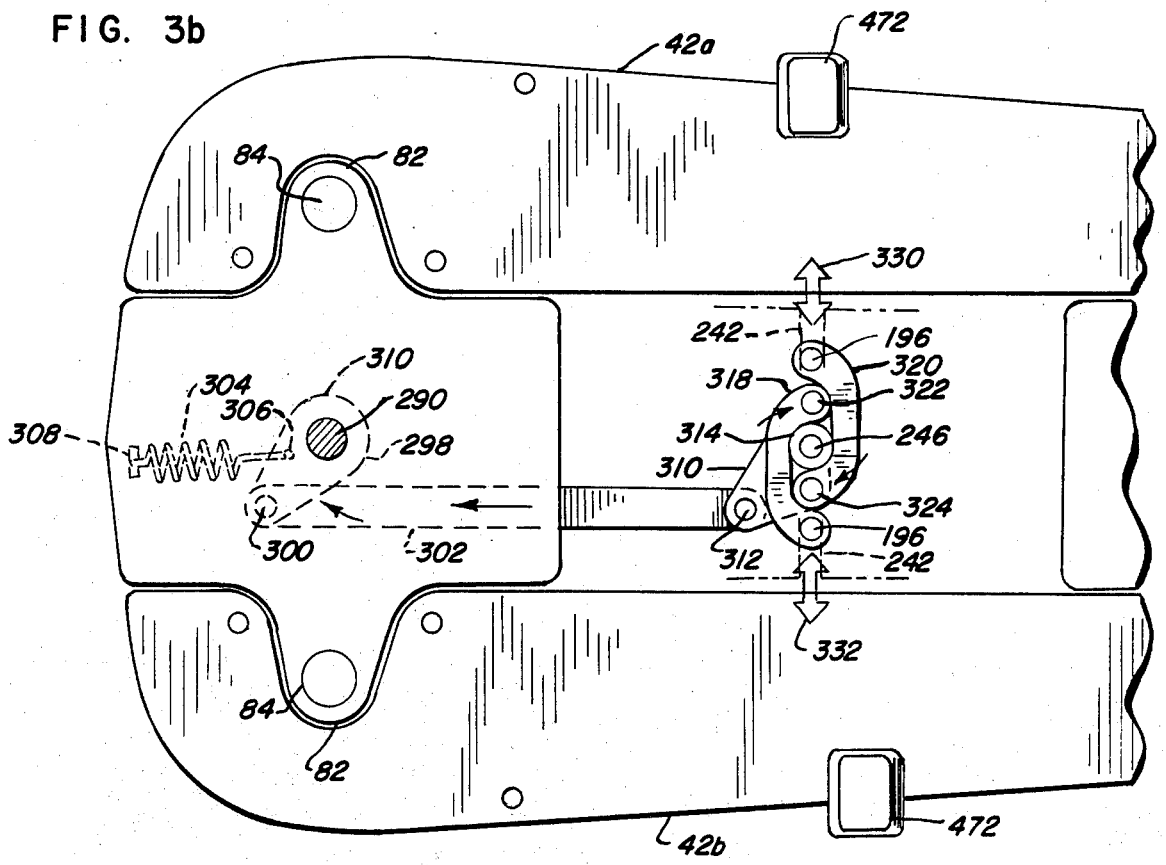

Referring to FIGS. 1, 2*a,* 2*b* and 13, a connector 30 is placed within the above described connector holder by rotating the control 40 counterclockwise to the open position, thus translating the side members 38 in the direction of arrows 640 in FIG. 2*a.* Thereafter, the connector is placed on the support member 250 as shown, and the control 40 is rotated clockwise to the lock position. This results in the translation of the side members 38 in the direction of the arrows 642 of FIG. 2*b.* If the terminal channels at each end of the connector are properly aligned with the previously described nubs 227, the side members 38 assume the position shown in FIG. 2*b* with the nubs 227 restraining the connector in the connector holder in proper alignment with the ribs 202 and rams 420 longitudinally of the tool. As shown in FIG. 13, which is a simplified sectional view of the tool, the connector 30 is maintained in firm contact with the support member 250 by engagement of the surfaces 222 upon the shoulders 524 of the connector to effect vertical alignment of the connector with the rams 420. In fact, the member 250 may be forced downward slightly against springs 254 in response to the applied force.

Figure 8:
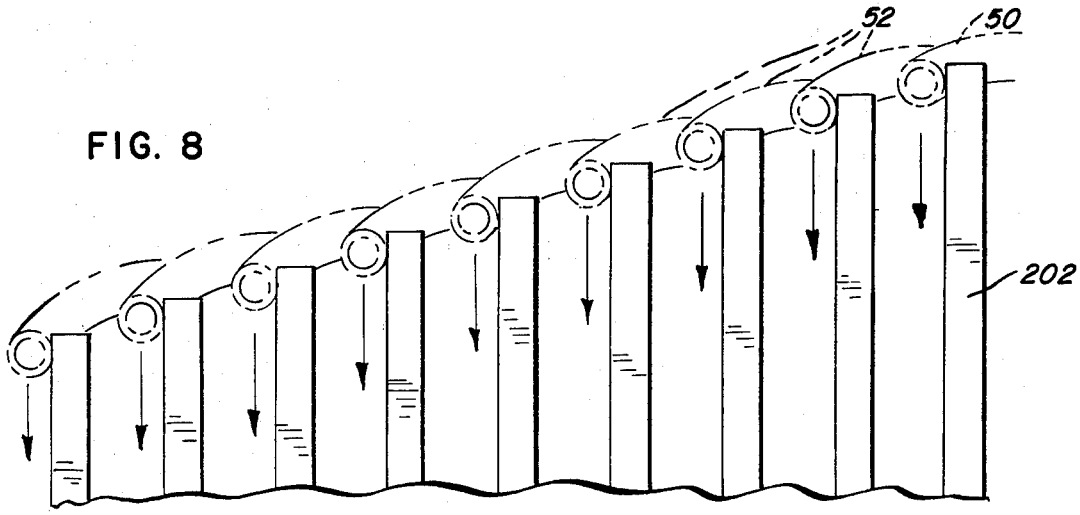
FIG. 8 is a schematic view representing insertion of wires into the guide combs shown in FIG. 1.

After the connector is placed in the connector holder, the wires such as wire 50 are individually placed in the interstices between the ribs 202, as further described in the aforementioned application Ser. No. 549,715. This placement is illustrated generally in FIG. 8, where it can be seen that the wires 50 and 52 are individually placed between the respective ribs, and moved downward, generally until they come to rest against the connector and/or the respective surface 230. The stepped height characteristic of the ribs 202 assists the operator in so placing the wires. After having placed a wire such as wire 50 between ribs 202, its distal end is placed between corresponding ribs of the secondary comb 58 and may be bent forward or aft of the tool against the adjacent rib 354 to provide an axial restraining force along the wire.

After all of the wires 50 and 52 have been placed in appropriate interstices between the ribs 202, and assuming proper setting of the ram block extension adjustments for the connectors being used, the ram arms 42 with their rams 420 are pivoted closed to insert the wires into the respective terminals by manipulation of the arms 42 and 48 as described above. More specifically, as the rams 420 are moved between the ribs 202, the surfaces 540*c* of the blades engage the wires, for example, the wire 50 in FIG. 13, and force them against the cutting edges of the segments 226. As a result, each wire is trimmed by a severing action between these segment edges and the cooperating edges of the rams. As the rams are further inserted between the ribs 202, the wires are pushed further into the respective connector terminals until all of the wires are seated firmly against the bottom walls 505 as the arms 48 reach their mutually abutting limit positions as in FIG. 14. The fulcrums and the designs of the arms are such that the arms 42 are in fixed predetermined positions with the ram blade ends of the two ram sets in parallel opposed positions, for uniform seating of all of the wires in a connector, when the arms reach these limit positions. Further, the wedge adjustments of the ram blocks are oriented for moving each ram set perpendicular to these parallel positions to insure maintenance of this parallelism as the blocks are adjusted, such as in adjusting for wear and in adjusting for different connectors as alluded to above. The depressions 540*d* and 540*e* and the diminished area 540*f* in each blade 540 permit the blades to be fully inserted in the terminals without damaging the jaws 506 and the tabs 508 of the terminals. After seating the wires as described, the rams are withdrawn and the insertion operation is complete. At this point the distal ends of the inserted wires, namely, those ends which have been trimmed from the inserted wires, are removed from the tool by pulling them from between the ribs of the comb 58.

It should be noted that with a connector 30 mounting in the tool as above described, the side members 38*a* and 38*b* are locked in a fixed position relative to each other and cannot be separated inadvertently while wires are being inserted as above described. Yet the entire connector carriage including the subassembly 36, the side members 38*a* and 38*b,* and the attached portions of the control linkage, is free floating collectively and may freely translate laterally within the limits of lateral movement of pin 246 in recess 122. This provides an automatic self-centering of the connector in response to the forces applied by the ram arms 42 through the rams 420 and attendant automatic balancing of the insertion forces applied to the connector from the two sides. This is important to avoid physical damage to connectors. Moreover, this automatic centering and balancing of forces permits adjustment of the tool for different connector base widths 518 by adjusting only one of the ram blocks relative to its drive arm, while maintaining fixed pivot and fulcrum axes and fixed limit stop positions for the arms.

Figure 14:
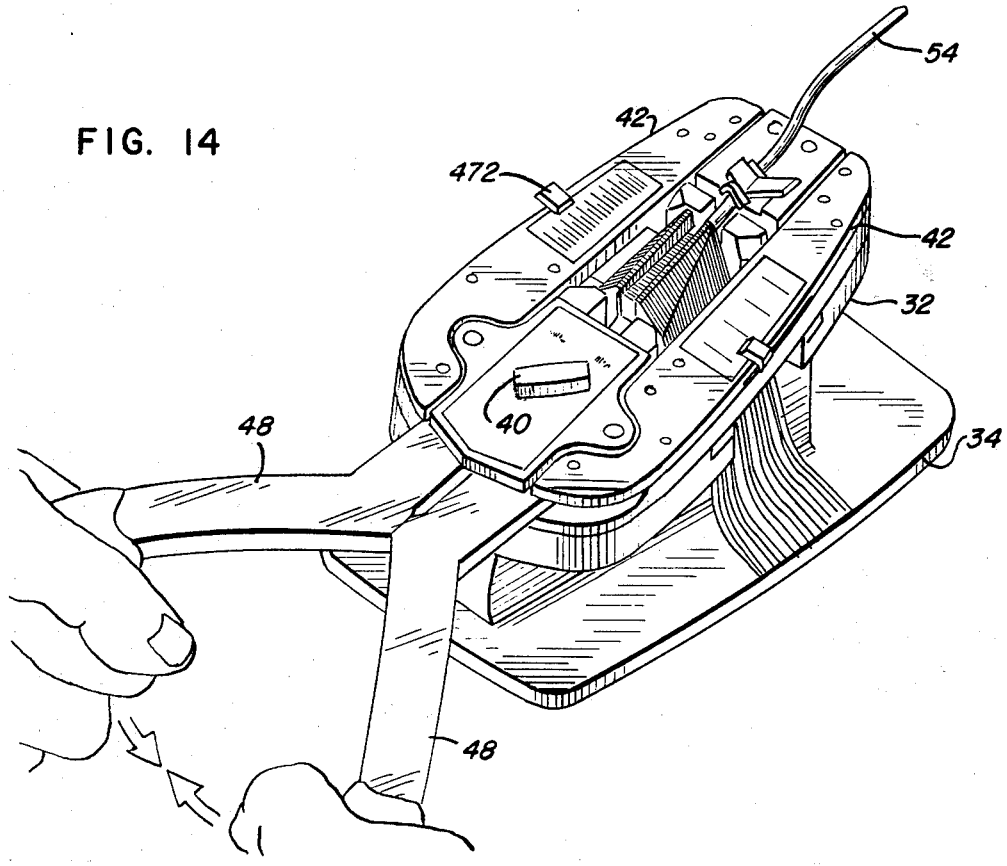
FIG. 14 is an oblique view of the tool of FIG. 1 after having forced wires into a connector.

The appearance of the tool in its operated condition, having inserted the rams and wires into the terminals of the connector 30, is presented in oblique view in FIG. 14.

In describing certain components herein, the terms horizontal and vertical have been used for convenience. It will be appreciated that in some instances such terms are relative to the inclined support frame plate 32, and should be construed accordingly.

In adapting the described apparatus for various types of connectors, relative dimensions and the configurations of various components will be varied, in addition to those already noted. For example the support plate 250 may be of differing height and configuration to receive different connectors, and different connector alignment means may be incorporated in accordance with the connector design. It will be obvious that other modifications of the specific embodiments shown may be made without departing from the spirit and scope of the invention.

It will be seen that improved wire termination apparatus has been provided which meets the objects of the invention.

While a particular embodiment of this invention has been shown, it will be understood, of course, that the invention is not limited thereto since modifications may be made by those skilled in the art, particularly in light of the foregoing teachings. Therefore, it is contemplated by the appended claims to cover any such modifications as incorporate those features which may be said to constitute the essential features of these improvements within the true spirit and scope of the invention.

What is claimed is:

1. Apparatus for terminating wires in terminals of a connector, comprising a frame, connector carriage means on said frame for supporting such a connector, means for aligning wires with such terminals of a connector supported on said connector carriage means, and insertion means comprising a first member mounted on said frame for pivotal movement into insertion engagement with a connector supported on said connector carriage means and including insertion rams for forcing aligned wires from said aligning means into said terminals of such a connector upon such engagement, said connector carriage means comprising first and second side members and a connector support member, all of said first and second side members and said connector support member being laterally translatable on said frame, generally parallel to the direction of and in response to said movement of said first member at insertion, within predetermined limits.

2. Apparatus as in claim 1 for use with a connector having terminals positioned on opposed sides thereof, wherein said first member is mounted for movement toward a first of such opposed sides of a connector supported on said connector carriage means, and said insertion means further comprises a second member mounted on said frame for movement toward a second of such opposed sides of such a connector, and including insertion rams for forcing aligned wires from said aligning means into terminals of such a connector.

3. Apparatus for terminating wires in terminals of a connector wherein said terminals are arranged parallel to each other on opposing faces of said connector, comprising support means having two movable side members for selectively engaging opposing sides of such a connector, means for positioning said two side members laterally at a plurality of positions relative to each other, in one of said positions said side members engaging such a connector, said means for positioning said side members locking the position of said side members relative to each other, and in another of said positions said side members being retracted from such a connector, first guide means for aligning wires with terminals on one of such opposing faces of a connector supported by said support means, and insertion means including a first movable arm having extending rams, for forcing wires aligned with terminals on such a face of such a connector by said first guide means into such terminals.

4. Apparatus as in claim 3 wherein said first movable arm includes means for varying the extension of said rams from said first arm.

5. Apparatus as in claim 4 further comprising a second guide means for aligning wires with terminals on the other of such opposing faces of such a connector, and wherein said insertion means includes a second movable arm having extending rams for forcing wires aligned with terminals on such other face of such a connector by said second guide means into such terminals.

6. Apparatus as in claim 5 wherein said second movable arm includes means for varying the extension of said rams of said second movable arm from said second arm.

7. Apparatus for inserting wires into terminals of a connector, comprising means for supporting such a connector including a pair of side members, said side members each including guides for guiding said wires into alignment with terminals of such a connector, positioning means for establishing the relative positions of said side members, said positioning means including a toggle linkage comprising first and second toggle members, a toggle means connected to said toggle members to control the positioning of said toggle members, means for selectively positioning said toggle means, and connecting means for connecting each of said side members to a corresponding one of said toggle members, and means for forcing wires aligned by said guides into said terminals.

8. Apparatus as in claim 7 wherein said positioning means includes guide members defining channels, said connecting means being slidably engaged in said channels for movement therealong in predetermined directions.

9. Apparatus as in claim 7 wherein said means for selectively positioning said toggle means includes a drive link connected to said toggle means and a control means connected to said drive link to control the positioning of said drive link.

10. Apparatus as in claim 9 wherein said means for selectively positioning said toggle means further comprises a spring means for urging said control means to a predetermined rest position.

11. Apparatus as in claim 7 wherein each of said guides comprises a comb having parallel ribs connected by bridging elements, said ribs sequentially varying in height and shape from one end of said comb to the other, and each of said bridging elements including a cutting edge positioned to cooperatively operate with said means for forcing wires into said terminals to trim said wires to a length appropriate for insertion into said terminals.

12. Apparatus for terminating a plurality of wires in a connector having a plurality of separate terminals, comprising means for supporting said connector, guide means for aligning said wires with said terminals of a connector supported by said support means, and insertion means for inserting wires aligned with said terminals by said guide means into said terminals, said insertion means including a first member supporting a first plurality of rams extending from said first member for forcing wires into terminals of such a connector, said first member being mounted for movement to a predetermined position relative to said support means when so forcing wires ito such a connector, and means for selectively adjusting the extension of said first plurality of rams from said first member to any extension between predetermined limits.

13. Apparatus as in claim 12 wherein said means for adjusting the extension of said first plurality of rams comprises a first wedge member connected to said first plurality of rams and slidably engaging a support surface of said first member, and a control means connected to said first wedge member for adjusting said first wedge member relative to said first member to adjust the extension of said first plurality of rams therefrom.

14. Apparatus as in claim 12 for use with a connector having terminals arranged in first and second rows on opposing sides of said connector, wherein said guide means includes a first guide element for aligning wires with said terminals of said first row and a second guide element for aligning wires with said terminals of said second row, said first member being positioned for movement of sid first plurality of rams thereon through said first guide element of said guide means into said first row of terminals, and wherein said insertion means further comprises a second member supporting a second plurality of rams extending from said second member, and said second member being mounted for movement of said second plurality of rams thereon through said second guide element of said guide means into said second row of terminals.

15. Apparatus as in claim 14 including means on said second member for varying the extension of said second plurality of rams therefrom.

16. Apparatus as in claim 15 wherein said means for adjusting the extension of said second plurality of rams on said second member comprises a second wedge member connected to said second plurality of rams and slidably engaging a support surface of said second member and a control means connected to said second wedge member for adjusting said second wedge member relative to said second member to adjust the extension of said second plurality of rams therefrom.

17. Apparatus as in claim 12 wherein said guide means comprises a first comb means for aligning said wires with said terminals, said comb means having a plurality of ribs interconnected by bridging elements, each of said bridging elements including a cutting surface positioned for cooperative operation with said first plurality of rams on said first member to trim said wires prior to insertion in said terminals.

18. Apparatus as in claim 17 for use with a connector having terminals arranged in first and second rows on opposing sides of said connector, wherein said first comb means aligns wires with said terminals of said first row, and said guide means further comprising a second comb means for aligning wires with said terminals of said second row, and said insertion means further including a second member supporting a second plurality of rams, said second member being mounted for movement to a predetermined position relative to said support means when forcing wires into such a connector, and said second comb means having a plurality of ribs interconnected by bridging elements, each of said bridging elements of said second comb means including a cutting surface positioned for cooperative operation with said second plurality of rams on said second member to trim said wires prior to insertion in said terminals of said second row.

19. Apparatus as in claim 12 wherein said means for supporting said connector comprises first and second side members, and means for positioning said side members in first and second positions relative to each other.

20. Apparatus as in claim 19 wherein said guide means comprises first and second comb means respectively connected to said first and second side members, said comb means comprising ribs of varying length interconnected by bridging elements, each of said bridging elements including a cutting surface positioned for cooperative operation with said insertion means to trim said wires prior to insertion in said terminals.

21. Apparatus as in claim 12 wherein said insertion means further includes a second member supporting a second plurality of rams, said second member being mounted for movement to a predetermined position relative to said support means when so forcing wires into a connector.

22. Apparatus for terminating wires in terminals of a connector, such terminals being positioned on opposed sides thereof, comprising a frame, connector carriage means on said frame for supporting such a connector, means for aligning wires with such terminals of a connector supported on said connector carriage means and insertion means comprising a first member mounted on said frame for movement toward a first of such opposed sides of a connector supported on said connector carriage means and a second member mounted on said frame for movement toward a second of such opposed sides of such a connector, said first and second members including insertion rams for forcing aligned wires from said aligning means into such terminals of such a connector, said connector carriage means comprising first and second side members and a connector support member, all of said first and second side members and said connector support member being laterally translatable on said frame, generally parallel to the direction of and in response to said movement of said members at insertion, within predetermined limits.

23. Apparatus for terminating wires in terminals of a connector, such terminals being positioned on opposed sides thereof, comprising a frame, connector carriage means on said frame for supporting such a connector, means for aligning wires with such terminals of a connector supported on said connector carriage means and insertion means comprising a first member mounted on said frame for movement toward a first of such opposed sides of a connector supported on said connector carriage means and a second member mounted on said frame for movement toward a second of such opposed sides of such a connector, said first and second members including insertion rams for forcing aligned wires from said aligning means into such terminals of such a connector, said connector carriage means being laterally translatable on said frame generally parallel to the direction of said movement of said members at insertion within predetermined limits, said connector carriage means including first and second side members and means for selectively translating said side members relative to each other or immobilizing said side members relative to one another at a predetermined mutual displacement.

24. Apparatus as in claim 23 wherein said means for aligning wires with such terminals comprises a plurality of ribs extending from said side members.

25. Apparatus as in claim 23 wherein said connector carriage means includes means for controlling the movement of said side members relative to one another.

26. Apparatus for terminating wires in terminals of a connector, such terminals being positioned on opposed sides thereof, comprising a frame, connector carriage means on said frame for supporting such a connector, means for aligning wires with such terminals of a connector supported on said connector carriage means and insertion means comprising a first member mounted on said frame for movement toward a first of such opposed sides of a connector supported on said connector carriage means and a second member mounted on said frame for movement toward a second of such opposed sides of such a connector, said first and second members including insertion rams for forcing aligned wires from said aligning means into such terminals of such a connector, said connector carriage means being laterally translatable on said frame generally parallel to the direction of said movement of said members at insertion within predetermined limits, said insertion rams extending from said members and at least one of said members including means for varying the extension of the respective insertion rams from said member to any extension between predetermined limits.

27. Apparatus for terminating wires in terminals of a connector, such terminals being positioned on opposed sides thereof, comprising a frame, connector carriage means on said frame for supporting such a connector, means for aligning wires with such terminals of a connector supported on said connector carriage means and insertion means comprising a first member mounted on said frame for movement toward a first of such opposed sides of a connector supported on said connector carriage means and a second member mounted on said frame for movement toward a second of such opposed sides of such a connector, said first and second members including insertion rams for forcing aligned wires from said aligning means into such terminals of such a connector, said connector carriage means being laterally translatable on said frame generally parallel to the direction of said movement of said members at insertion within predetermined limits, said connector carriage means including a support for a connector, a pair of side members movable relative to one another and to said support for engaging opposite sides of a connector on said support, and means for moving said side members relative to one another to engage and disengage a connector on said support, said carriage means being slidably mounted on said frame for free, lateral translational movement as said rams force such wires into a connector held thereon.

* * * * *